US011072960B2

(12) United States Patent
Lee et al.

(10) Patent No.: US 11,072,960 B2
(45) Date of Patent: Jul. 27, 2021

(54) REFRIGERATOR

(71) Applicant: LG ELECTRONICS INC., Seoul (KR)

(72) Inventors: Sunghun Lee, Seoul (KR); Dongjeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 59 days.

(21) Appl. No.: 16/347,383

(22) PCT Filed: Nov. 3, 2017

(86) PCT No.: PCT/KR2017/012446

§ 371 (c)(1),
(2) Date: May 3, 2019

(87) PCT Pub. No.: WO2018/084654

PCT Pub. Date: May 11, 2018

(65) Prior Publication Data

US 2020/0263479 A1 Aug. 20, 2020

(30) Foreign Application Priority Data

Nov. 3, 2016 (KR) ..... 10-2016-0145944

(51) Int. Cl.
*E05F 15/619* (2015.01)
*F25D 23/02* (2006.01)
*F25D 29/00* (2006.01)

(52) U.S. Cl.
CPC ..... *E05F 15/619* (2015.01); *F25D 23/028* (2013.01); *F25D 29/005* (2013.01); *E05Y 2900/31* (2013.01)

(58) Field of Classification Search
CPC ..... F25D 23/028; F25D 29/00; F25D 29/005; F25D 2323/02; E05F 15/619; E05Y 2900/31
See application file for complete search history.

(56) References Cited

U.S. PATENT DOCUMENTS 4,644,693 A * 2/1987 Wang ..... E05F 15/619 49/280
9,663,982 B1 * 5/2017 Cui ..... F25D 23/028
(Continued)

FOREIGN PATENT DOCUMENTS

DE 10063743 A1 * 7/2002 ..... E05F 15/622
DE 102005028448 A1 * 12/2006 ..... A47L 15/4259
(Continued)

OTHER PUBLICATIONS

Translated Description JP2015055130A, 60 pages (Year: 2015).*
(Continued)

*Primary Examiner* — Andrew M Roersma
(74) *Attorney, Agent, or Firm* — Fish & Richardson P.C.

(57) ABSTRACT

The present invention relates to a refrigerator which allows a user to easily open the doors of the refrigerator. To achieve the aforementioned purpose, provided according to one embodiment of the present invention can be a refrigerator comprising: a cabinet having storage chambers; doors for opening/closing the storage chambers; and door opening devices operating so as for the doors to open, wherein the door opening devices comprise: a motor provided so as to generate a driving force; and a rack provided in a direction diagonal to the front side of the cabinet, wherein the rack is moved in the lengthwise direction thereof by the drive of the motor.

20 Claims, 5 Drawing Sheets

(56) References Cited

U.S. PATENT DOCUMENTS

| | | | | |
|---|---|---|---|---|
| 2016/0242542 | A1* | 8/2016 | Friesenecker | A47B 88/457 |
| 2019/0162006 | A1* | 5/2019 | Lee | E05F 15/616 |
| 2019/0330909 | A1* | 10/2019 | Lee | F25D 23/028 |
| 2020/0095818 | A1* | 3/2020 | Lee | F25D 29/00 |

FOREIGN PATENT DOCUMENTS

| | | | | |
|---|---|---|---|---|
| DE | 202014005067 | U1 * | 10/2014 | E05F 15/77 |
| EP | 2148035 | | 1/2010 | |
| EP | 2660544 | A2 * | 11/2013 | F25D 23/028 |
| JP | 2001055863 | | 2/2001 | |
| JP | 2003262456 | | 9/2003 | |
| JP | 2015-055130 | | 3/2015 | |
| JP | 2015055437 | | 3/2015 | |
| JP | 2015105765 | | 6/2015 | |
| KR | 10-1997-0022158 | | 5/1997 | |
| KR | 20-1998-0051710 | | 10/1998 | |
| KR | 10-2009-0091455 | | 8/2009 | |
| KR | 20120003772 | | 1/2012 | |
| KR | 10-2016-0029514 | | 3/2016 | |
| KR | 20160029514 | | 3/2016 | |
| WO | WO-2016036212 | A1 * | 3/2016 | E05F 15/614 |
| WO | WO-2016036213 | A1 * | 3/2016 | F25D 29/00 |
| WO | WO-2016175562 | A1 * | 11/2016 | E05F 15/73 |

OTHER PUBLICATIONS

Translated Description JP2003262456A, 10 pages (Year: 2003).*
Extended European Search Report in European Appln. No. 17867468.5, dated May 15, 2020, 8 pages.
Chinese Office Action in Chinese Appln. No. 201780068137.2, dated Nov. 13, 2020, 15 pages (with English translation).
European Office Action in European Appln. No. 17 867 468.5, dated Mar. 11, 2021, 6 pages.

* cited by examiner

REFRIGERATOR

TECHNICAL FIELD

The present invention relates to a refrigerator, and more particularly, to a refrigerator in which a user is capable of easily opening a door of the refrigerator.

BACKGROUND ART

Refrigerators are household appliances that are capable of store objects such as foods at a low temperature in a storage chamber provided in a cabinet. The storage chamber is surrounded by heat insulating wall so that the inside of the storage chamber is maintained at a temperature less than an external temperature. The storage chamber may be referred to as a refrigerating compartment or a freezing compartment according to a temperature range of the storage chamber.

A user open and close the storage chamber through a door. The user opens the door to put the object into or out of the storage chamber. In general, the door is rotatably provided on the cabinet, and a gasket is disposed between the door and the cabinet. Thus, in a state in which the door is closed, the gasket is closely attached between the door and the cabinet to prevent cold air within the storage chamber from leaking. As the closely attaching force of the gasket increases, the cold air leakage prevention effect may increase.

To allow the closely attaching force of the gasket to increase, the gasket may be provided as a rubber magnet, and a magnet may be provided in the gasket. However, when the closely attaching force of the gasket increases, it means that large force as much as the closely attaching force is required to open the door.

In recent years, a refrigerator having an auto closing function is being provided. The auto closing function means a function of automatically closing the door of the refrigerator when the door of the refrigerator is slightly opened by using the closely attaching force of the gasket, magnetic force, and elastic force of a spring. Also, the auto closing function means that the door of the refrigerator does not open by itself even when the refrigerator is slightly tilted forward.

Thus, the refrigerators provided in recent years require much more force to open the door when compared to the previous refrigerators. This is done because it is necessary to overcome the closely attaching force, the magnetic force, and the elastic force so as to open the door of the refrigerator.

For example, the user may need force of 6 kgf to open the door of the refrigerator. Since this force is relatively large, it is impossible to easily open the door. Also, a problem may arise that the door is rapidly opened because very large force is applied to open the door.

Disclosure of the Invention Technical Problem

A basic object of the present invention is to solve the problem of the above-described refrigerator according to the related art.

An embodiment provides a refrigerator that is easily used by reducing user's force required for opening a door of the refrigerator An embodiment provides a refrigerator in which a door of the refrigerator is easily opened while maintaining closing force of the door of the refrigerator.

An embodiment provides a refrigerator in which a door of the refrigerator is easily opened while maintaining an auto closing function of the refrigerator door.

An embodiment provides a refrigerator in which an angle at which a door is automatically openable increases to improve user's convenience.

An embodiment provides a door opening device that is very effectively implemented while easily changing a configuration of the door opening device according to the related art and a refrigerator including the same.

An embodiment provides a refrigerator which prevents a distal end of a rack closely attached to a cabinet or a door from being deformed or damaged and effectively transmits force pushed from the rack.

Technical Solution

To realize the above-mentioned object, according to an embodiment of the present invention, a refrigerator comprises: a cabinet having a storage chamber; a door configured to open and close the storage chamber; and a door opening device configured to operate so as to open the door, wherein the door opening device comprises: a motor provided to generate driving force; and a rack provided in a diagonal direction with respect to a front surface of the cabinet, wherein the rack moves in a longitudinal direction thereof by driving of the motor.

The door opening device may comprise a housing, and the rack may move so that the housing varies in protruding length.

The motor may be driven in a first direction so that the protruding length of the rack increases to open the door.

The motor may be driven so that the protruding length of the rack is maximized and then driven in a second direction so that the protruding length of the rack decreases.

At least a portion of the motor may be accommodated in the housing. Alternatively, at least a portion of the rack may also be accommodated in the housing.

A rack support for guiding the movement of the rack and supporting the rack may be disposed at the housing.

Also, at least one or more gears may be provided in the housing. The gears may transmit driving force and speed between the motor and the rack. The gear may be a reduction gear for deceleration.

The door opening device may be provided in the door.

The rack may be disposed at a diagonal angle with respect to a rear surface of the door, and the diagonal angle may be uniformly maintained regardless of an opening angle of the door and the protruding length of the rack. For this, the housing may be fixed to the inside of the door, and the moving direction of the rack may be equal to a longitudinal direction of the rack.

The rack may be disposed at a diagonal angle with respect to a thickness direction of the door.

As the rack protrudes, the rack may push the cabinet so that an opening angle of the door increases.

When a protruding rate of the rack is uniform, an increasing rate of the opening angle of the door may gradually increase and then gradually decrease.

As the door is initially opened to increase in opening angle, the tilted diagonal angle of the rack may gradually decrease to be erected and then increase again.

The rack may comprise: a rack body having gear teeth on an outer surface thereof; and a rack cover disposed on a distal end of the rack body.

A rack entrance through which the rack is accessible may be provided in a rear surface of the door, and when the rack is returned to its original position after protruding, the rack cover may close the rack entrance.

Thus, the rack may not protrude from a front surface of the door but be disposed in the door. As a result, a component in a thickness direction of the door with respect to a total length of the rack may not be greater than a thickness of the door. When the door decreases in thickness, the component in the thickness direction of the door with respect to the total length of the rack may more decrease.

However, as a tilted angle of the rack with respect to the thickness direction of the door increases, the total length of the rack may increase. This is done because the total length of the rack further increases as the tilted angle of the rack increases in spite of that the component in the thickness direction of the door is uniform.

The rack cover may be made of an elastic material, and the rack cover may comprise a rear surface closely attached to the cabinet, a front surface parallel to the rear surface, a vertical one side surface configured to connect the front surface to the rear surface, and the other side surface disposed obliquely to be parallel to the longitudinal direction of the rack, the other side surface being adjacent to a rotation center of the door.

The rack cover may be provided as a block having a trapezoidal horizontal cross-section.

The rear surface of the rack cover may have an area greater than that of the front surface.

Due to the configuration of the rack cover, a contact surface between the rack cover and the cabinet may be effectively maintained so that the rack cover effectively seals the rack entrance.

The rack cover may be rotatably provided on the rack body. Thus, even though the angle between the rack and the cabinet varies, force of the rack may be effectively transmitted to the cabinet.

To realize the above-mentioned object, according to an embodiment of the present invention, a refrigerator comprises: a cabinet having a storage chamber; a door configured to open and close the storage chamber; and a door opening device configured to operate so as to open the door, wherein the door opening device comprises: a motor configured to generate driving force; and a rack provided in a diagonal direction with respect to a front surface of the cabinet to move in a longitudinal direction thereof by driving of the motor and thereby to open the door, wherein a rack cover that is rotatable so that force varying in direction by the movement of the rack is transmitted to the cabinet or the door in a state of being closely attached to the cabinet or the door is provided on a distal end of the rack.

Advantageous Effects

A basic object of the present invention is to solve the problem of the above-described refrigerator according to the related art.

The embodiment may provide the refrigerator that is easily used by reducing the user's force required for opening the door of the refrigerator The embodiment may provide the refrigerator in which the door of the refrigerator is easily opened while maintaining the closing force of the door of the refrigerator.

The embodiment may provide the refrigerator in which the door of the refrigerator is easily opened while maintaining the auto closing function of the refrigerator door.

The embodiment may provide the refrigerator in which the angle at which the door is automatically openable increases to improve the user's convenience.

The embodiment may provide the door opening device that is very effectively implemented while easily changing the configuration of the door opening device according to the related art and the refrigerator including the same.

The embodiment may provide the refrigerator which prevents the distal end of the rack closely attached to the cabinet or the door from being deformed or damaged and effectively transmits the force pushed from the rack.

The embodiment may provide the refrigerator in which the opening speed of the door gradually increases and then decreases to reduce the initial opening impact of the door and recognize that the door is relatively quickly opened.

The embodiment may provide the refrigerator in which the rack entrance through which the rack is accessible is effectively sealed. Also, the refrigerator in which the rack is smoothly accessible through the rack entrance may be provided.

The embodiment may provide the refrigerator in which the surface on which the rack and the cabinet are closely attached to each other is effectively maintained.

Thus, the force of the rack, which is applied to the cabinet, may be effectively transmitted.

The embodiment may provide the refrigerator in which the deviation between the maximum load and the minimum load, which are applied to the door opening device, is reduced. Thus, the door opening device may be improved in reliability.

MODE FOR CARRYING OUT THE INVENTION

Figure 1:
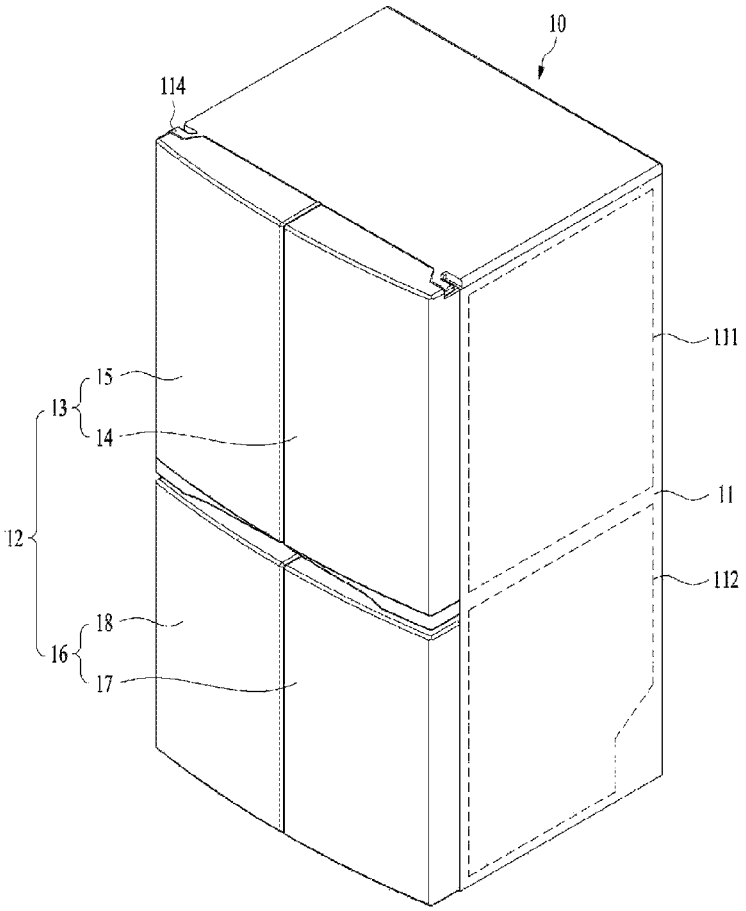
FIG. 1 is a perspective view of a refrigerator that is applicable to an embodiment of the present invention.

Hereinafter, preferred embodiments of the present invention will be described with reference to the drawing.

FIG. 1 is a perspective view of a refrigerator that is applicable to an embodiment of the present invention. For example, a structure in which two doors that open and close an upper refrigerating compartment and two doors that open and close a lower freezing compartment are provided is illustrated.

The refrigerator according to an embodiment of the present invention may comprise a cabinet 10 having a storage chamber and a door 12 provided on the cabinet 10. The storage chamber defined by the cabinet may be opened and closed through the door 12. Thus, the refrigerator may have an outer appearance defined by the cabinet 10 and the door 12.

Since a user uses the refrigerator at a front side of the refrigerator, the door is disposed on the front of the refrigerator.

For example, a refrigerating compartment door 13 for opening and closing the refrigerating compartment 111 may be provided. The refrigerating compartment door 13 may be constituted by left and right doors 15 and 14. Also, a freezing compartment door 16 for opening and closing the freezing compartment 112 may be provided. The freezing compartment door 16 may be constituted by left and right doors 18 and 17.

The door 12 may be provided to be rotatable through a door hinge 114. That is, the door 12 may be provided to be rotatable with respect to the cabinet through the door hinge 114.

The user may grasp the door 12 to open and close the door. For this, a handle is provided on the door. In FIG. 1, an example in which handles 14*a*, 15*a*, 17*a*, and 18*b* are respectively provided on the doors 14, 15, 17, and 18 is illustrated.

That is, when the user intends to open the door, a hand of the user is intuitively accessed to the handles. Also, the user grasps the handles to apply force for pulling the door. Embodiments of the present invention may be provided to improve user's convenience by using the user's intuitive operation.

Figure 2:
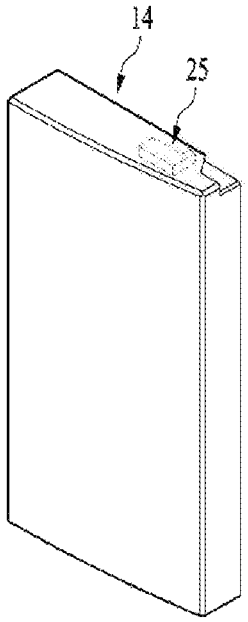
FIG. 2 is a perspective view of a door illustrated in FIG. 1.

FIG. 2 is a perspective view of the door illustrated in FIG. 1. For convenience of description, the left refrigerating compartment door 14 is illustrated.

Embodiments of the present invention may comprise a door opening device 25 that automatically opens the door. That is, a device for automatically opening the door through an electric motor may be provided. As illustrated in FIG. 2, the device may be provided in the door. On the other hand, the device may be provided in the cabinet.

The door opening device 25 is driven in preset conditions or states. The door opening device 25 is driven to automatically open the door. Thus, user's force required for opening the door may be significantly reduced.

Figure 3:
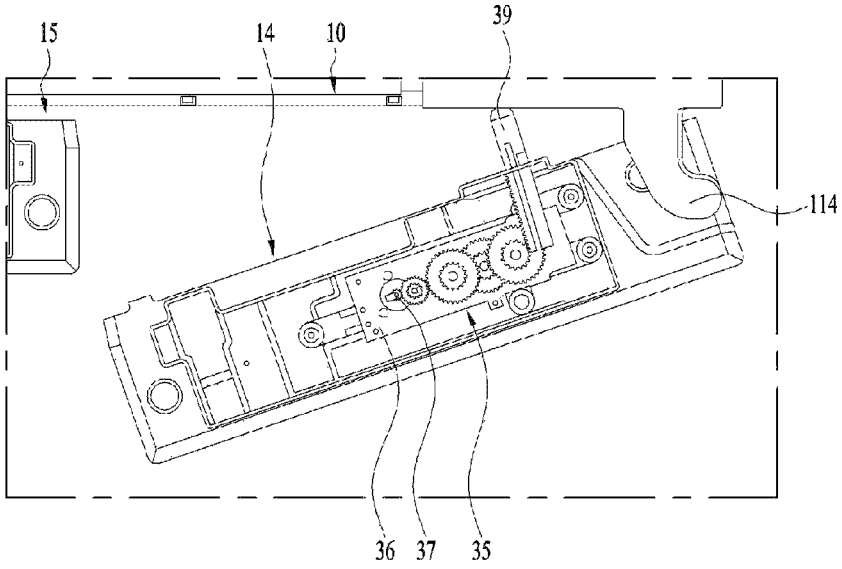
FIG. 3 is a plan view illustrating an example of an operation of a door opening device including a linear rack according to a related art.

FIG. 3 is a plan view illustrating an example of a refrigerator to which a door opening device 35 according to the related art is applied.

The door opening device 35 comprises a housing 36. At least one or more gears 38 may be received in the housing 36. The gears 38 are operated by driving of a motor 36. The rotation of the motor 36 that rotates at a high speed may be decelerated through the gears 38. At least a portion of the motor 36 may be received in the housing 36.

The housing 36 may be provided to be fixed to the door 14. The housing 36 may be mounted on a top surface of the door 14, and then, a cap decoration part (not shown) may cover the top surface of the door 14. Thus, most constituents of the door opening device including the housing 36 may be mounted in the door 14 so as to be protected from the outside.

The motor 36 is driven to open the door 14. Here, the gears 38 may also be driven by the driving of the motor 36. The driving force of the motor 36 may be transmitted to a rack 39 through the gears 38.

The rack 39 may be provided to protrude from the housing 36. That is, the rack 39 may be protruded from the housing and having a variable protruding length.

FIG. 3 illustrates a configuration in which the rack 39 further protrudes to the outside of the housing 36 to further protrude to the outside of the door 14. Thus, as the rack 39 increases in protruding length, the rack 39 may apply force so that the door 14 is away from the cabinet 10. On the other hand, in the state in which the door 14 is closed, the protruding length of the rack 39 may be minimized.

Here, the protruding length of the rack 39 may be proportional to an opening angle of the door 14. This is done because, when the door 14 rotates by using the door hinge 114 as a center, the rack 29 is maintained to contact the cabinet 10. However, since the contact position between the rack 39 having a linear shape and the cabinet 10 varies, the protruding length of the rack 39 and the opening angle of the door 14 may not be directly proportional to each other.

The increase of the protruding length of the rack 39 is limited. That is, an increase of an angle at which the door is automatically opened is limited. This is done because the protruding length of the rack 39 is not greater than a length of the rack 39. Also, this is done because the length of the rack is not greater than a front/rear width of the door 14, i.e., a thickness of the door.

Alternatively, the rack 39 may pass through the door 14 in forward and backward directions. However, in this case, a problem of design may be caused very seriously. Also, the exposure of the rack 39, which moves to the front of the refrigerator, may cause not only a design problem but also that the overall door opening device becomes complicated.

The rack 39 linearly moves. That is, in the state in which the door is closed, the rack 39 and the cabinet 10 are disposed to perpendicular to each other. However, as the angle at which the door is opened increases, an angle between the rack 39 and the cabinet 10 may vary.

This means that a portion on which the rack 39 and the cabinet 10 contact each other moves. Also, the force pushed by the rack 39 may be minimized, but the angle therebetween may be gradually tilted so that the force pushed by the rack 39 may not be properly transmitted to the cabinet.

Thus, the door opening device having a higher output may be required, or a problem in which force for opening the door is insufficient when the door is opened may occur.

In addition, a distal end of the rack 39 may be worn, or a portion of the cabinet, which contacts the distal end of the rack 29, may also be worn.

An embodiment of the present invention is to solve the problems of the door opening device in which the rack having the linear shape illustrated in FIG. 3 is used. In addition, an embodiment of the present invention is to provide a door opening device that is capable of effectively solving the problems without changing the structure of the overall door opening device.

Figure 4:
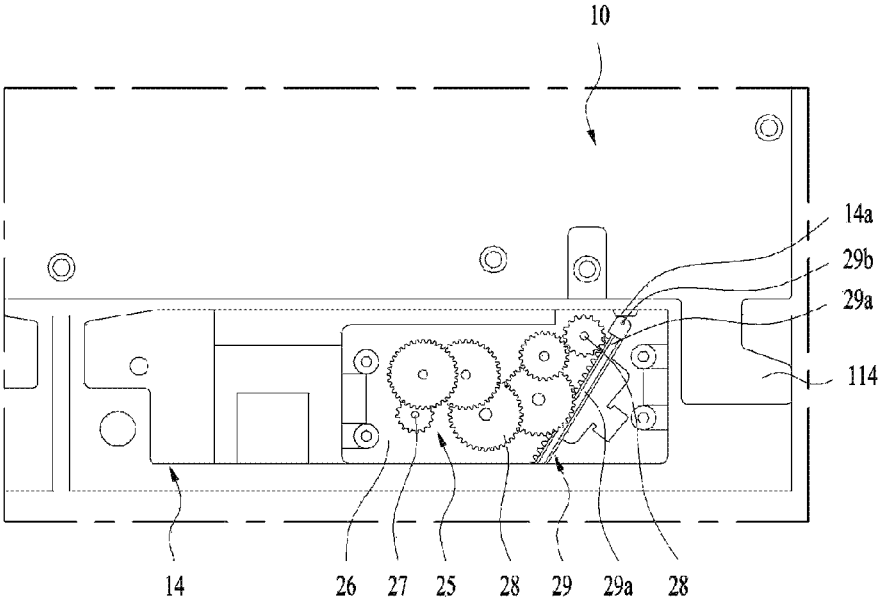
FIG. 4 is a plan view illustrating a state in which the door is closed in an door opening device that is applicable to an embodiment of the present invention.
Figure 5:
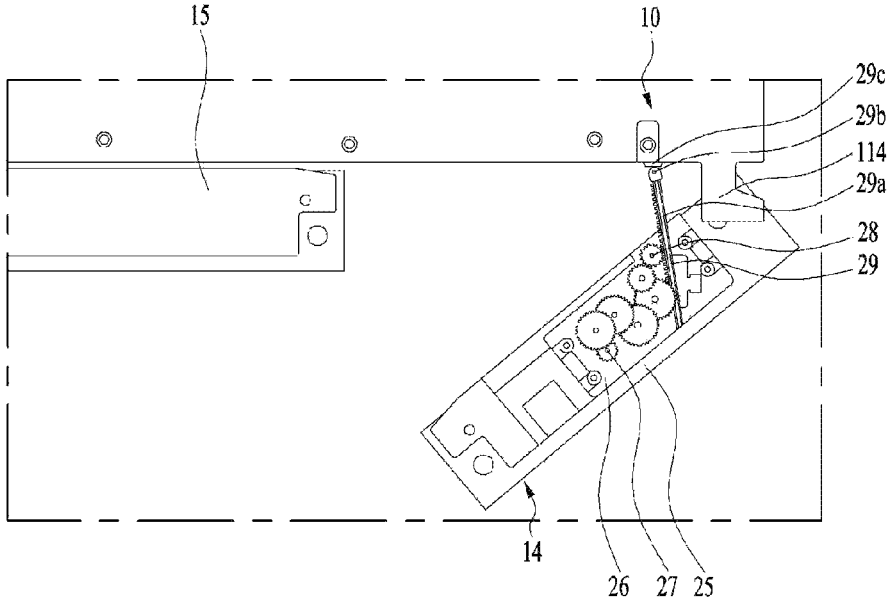
FIG. 5 is a view illustrating a state in which the door is opened in the door opening device that is applicable to an embodiment of the present invention.

FIGS. 4 and 5 illustrate an example in which a door opening device according to an embodiment of the present invention. FIG. 4 illustrates the door opening device in the state in which the door is closed, and FIG. 5 illustrates the door opening device in the state in which the door is opened.

Although the rack 39 described in FIG. 3 linearly moves, the door opening device 25 according to this embodiment may diagonally move. That is, other constituents are the same, but only a shape of the rack 39 is different.

Particularly, the rack 39 illustrated in FIG. 3 may have a shape that protrudes at an angle that is perpendicular to the door 14. However, in the door opening device 25 according to this embodiment, the rack 29 may have a shape that protrudes at an angle that is diagonal with respect to the door 14. That is to say, the rack 39 illustrated in FIG. 3 moves in the same direction as the thickness direction of the door 14. However, the rack 29 according to this embodiment may move in a direction that is tilted with respect to the thickness direction of the door 14.

Thus, in this embodiment, the rack 29 may have a length that is further greater than the thickness of the door 14. That is, this means that the protruding length of the rack 29 further increases. Thus, the angle at which the door is automatically opened may more increase.

As illustrated in FIG. 4, in the state in which the door 14 is closed, the rack 29 is disposed to be diagonal with respect to the front surface of the cabinet. Particularly, the rack 29 is diagonally disposed so that an angle between the rack 29 and a left front surface of the cabinet becomes an acute angle. Also, as illustrated in FIG. 5, in a state in which the door 14 is maximally opened through the rack 29, the rack 29 may be diagonally disposed so that an angle between the rack 29 and a right front surface of the cabinet becomes an acute angle. This means that the rack 29 is vertically disposed with respect to the front surface of the cabinet in a state in which the door is opened somewhat. Thus, a deviation in force by which the cabinet is pushed by the rack 29 may be very less between a time point at which the door is initially opened and a time point at which the door is maximally opened. Particularly, a deviation in force of an available component, which pushes the cabinet, may be very less.

On the other hand, in the door opening device 25 illustrated in FIG. 3, the force (the force of the available component) that pushes the cabinet through the rack 29 may be the largest at the time point at which the door is initially opened, and as the opening angle of the door increases, the force of the available component may more decrease. Thus, a deviation between a maximum load and a minimum load, which are applied to the door opening device 25, may be very large.

In general, a predetermined cap may be defined between the cabinet and the door. The gap may be defined by a gasket for preventing cold air from being lost.

In the door opening device, the rack protrudes to pass through the gap first. That is, when the door opening device is initially driven, the rack may not push the cabinet until the rack passes through the gap. Thus, the largest output may be generated at a portion at which the initial load is not applied.

However, in this embodiment, when the door opening device is initially driven, the rack may move in a diagonal shape. The largest output may not be generated at the portion at which the initial load is not applied.

Thus, according to this embodiment, the load applied to the motor driving the rack, the gear, and the rack itself may be reduced to provide the door opening device having reliability.

A relationship between the time and the opening angle of the door when assuming the protruding length of the rack is directly proportional to the time is as follows.

In the case of the linear rack 39 according to the related art, as a time elapses, the opening speed of the door is reduced. This is done because, as the time elapses, the tilted angle of the linear rack 39 with respect to the front surface of the cabinet more increases. Thus, the user has a perception that the door is opened too slowly after the door starts to be opened.

On the other hand, in the case of the diagonal rack 29, as a time elapses, the opening speed of the door increases and then decreases. This is done because, as the time elapses, the titled angle of the diagonal rack 39 with respect to the front surface of the cabinet decreases to be vertical and then decreases again. Thus, the user may not be aware of the decreases in post-opening speed because the opening speed of the door increases till a predetermined period after the door starts to be opened.

When the rack protrudes, a shape similar to that of a cantilever bar for the door may be provided. Thus, in the state in which the rack protrudes, the rack may be very vulnerable to an external impact. Thus, in view of the enlarged opening angle of the door, the protruding length of the rack is important. Also, in view of strength of the rack, a length of the rack, by which the rack is supported within the door after the rack maximally protrudes, is important.

As described above, the total length of the diagonal rack 29 may be further greater than that of the linear rack 39. That is, even though the same door 14 is mounted, the length of the diagonal rack 29 may more increase. This means that not only the length of the protruding rack but also the length of the rack supported in the door are capable of relatively increasing.

Even though an impact is applied to the protruding rack, the area or length of the rack supported in the door may more increase to disperse the impact. Thus, in the case of the diagonal rack, the rack may be more effectively protected again the external impact.

Thus, a very remarkable effect may be realized by simply changing the linear rack 39 into the diagonal rack 29.

It is preferable that the rack 29 is returned to its original position after protruding to open the door. That is, while the door is automatically opened, and then, the user further opens the door, the rack 29 is inserted again into the door 14. Here, the motor may be driven reversely.

Thus, a rack entrance 14*a* is provided in the rear surface of the door. When the door is completely opened, the rack entrance 14*a* may be exposed to user's viewing fields. When a gap is generated in the rack entrance 14*a*, an outer appearance may be deteriorated, and foreign substances may be introduced through the gap.

In this embodiment, it may be preferable that a rack cover 29*c* covering the rack entrance 14*a* is provided. It is preferable that the rack cover 29*c* is disposed at the distal end of the rack 29.

Particularly, the rack 29 may comprise a rack body 29*a*, and gear teeth may be provided on an outer surface of the rack body. After the driving of the motor is transmitted to the gears 27, the driving of the gears 27 may be transmitted to the rack body 29*a* through the gear teeth. Thus, the rack body 29*a* may be provided to linearly move in a tilted state with respect to the front surface of the door.

The rack cover 29*c* may be provided on the distal end of the rack body 29*a*. Here, it is preferable that an angle between the rack body 29*a* and the rack cover 29*c* varies according to the protruding length of the rack. That is, in the state in which the rack 29 is maximally inserted, the rack cover 29*c* may be aligned to match the rack entrance 14*a*, and then, the rack 29 may be withdrawn. Thus, it is preferable that the closely attaching force with the cabinet is continuously maintained.

For this, it is preferable that the rack cover 29*c* is rotatably connected to the rack body 29*a*. For this, a rotational shaft 29*b* rotatably supported by the rack cover 29*c* may be disposed on the rack body 29*a*.

It is preferable that the rack cover 29*c* is made of a rubber material or silicone material to provide the closely attaching force and the sealing force. The rack cover 29*c* may be returned to in a circular shape after a predetermined portion of the rack cover 29*c* is elastically deformed.

As illustrated in FIG. 4, the rack cover 29*c* may be a block of which an initial shape (a basic shape) has a trapezoidal horizontal cross-section. The rack cover 29*c* may have a front surface and a rear surface, which are parallel to each other. Also, the rack cover 29*c* may have one side surface having a straight line shape and the other side surface (a surface adjacent to the door hinge) having a diagonal line shape. The diagonal line shape may be parallel to the longitudinal direction of the rack 29 in the state in which the door is closed.

The rack cover 29*c* may be more easily accessible through the rack entrance 14*a* due to the shape of the rack cover 29*c*. Also, the rack cover 29*c* may more effectively seal the rack entrance 14*a*.

Also, an area of the rear surface (a surface contacting the cabinet) of the rack cover 29*c* may be greater than that of the front surface of the rack cover 29*c* due to the shape of the rack cover 29*c*. Thus, the force may be more effectively transmitted to the cabinet 10 through the rack 29. Also, even though the angle of the rack 29 with respect to the cabinet varies, the close attachment of the rack cover 29*c* may be maintained to more effectively transmit the force of the rack to the cabinet.

INDUSTRIAL APPLICABILITY

According to the embodiment of the present invention, since the refrigerator that is easily used by reducing the user's force required for opening the door of the refrigerator is provided, the industrial applicability is remarkable.

The invention claimed is:

1. A refrigerator comprising:

a cabinet including a storage chamber;

a door rotatably connected to the cabinet by a hinge and configured to open and close the storage chamber, the door comprising a door sidewall disposed adjacent to the hinge; and a door opening device disposed in the door and configured to open the door, wherein the door opening device comprises:

a motor configured to generate driving force, and a rack that extends along a longitudinal direction and that is configured to, based on operation of the motor, push the cabinet to open the door, the rack comprising:

a first end portion disposed adjacent to a front surface of the cabinet, a second end portion disposed at an opposite side of the first end portion, and gear teeth that are arranged along the longitudinal direction of the rack between the first end portion and the second end portion, the longitudinal direction of the rack being inclined with respect to a rear surface of the door that faces the front surface of the cabinet, wherein, in a state in which the door is closed, a horizontal distance between the door sidewall and the first end portion is less than a horizontal distance between the door sidewall and the second end portion, and wherein the rack is configured to move along the longitudinal direction based on operation of the motor to open the door.

2. The refrigerator of claim 1, wherein the door opening device further comprises a housing that accommodates the rack, and wherein the rack is configured to, based on operation of the motor, protrude from the housing to thereby vary a protruding length of the rack outside of the housing.

3. The refrigerator of claim 2, wherein the motor is driven in a first direction so that the protruding length of the rack increases to open the door.

4. The refrigerator of claim 3, wherein the motor is driven so that the protruding length of the rack is maximized and then driven in a second direction so that the protruding length of the rack decreases.

5. The refrigerator of claim 2, wherein an inclination angle of the rack relative to the rear surface of the door is maintained regardless of an opening angle of the door relative to the cabinet and the protruding length of the rack.

6. The refrigerator of claim 1, wherein the rack defines a diagonal angle with respect to a thickness direction of the door.

7. The refrigerator of claim 6, wherein the rack is configured to, based on protruding toward the cabinet, push the cabinet and increase an opening angle of the door with respect to the cabinet.

8. The refrigerator of claim 7, wherein, when a protruding rate of the rack is uniform, a rate of the opening angle of the door gradually increases and then gradually decreases.

9. The refrigerator of claim 7, wherein, as the door is initially opened to increase in opening angle, the diagonal angle of the rack gradually decreases to be erected and then increases again.

10. The refrigerator of claim 1, wherein the rack comprises:

a rack body having the gear teeth on an outer surface thereof; and a rack cover disposed on a distal end of the rack body.

11. The refrigerator of claim 10, wherein a rack entrance through which the rack is accessible is provided in a rear surface of the door, and when the rack is returned to its original position after protruding, the rack cover closes the rack entrance.

12. The refrigerator of claim 11, wherein the rack cover is made of an elastic material, and the rack cover comprises a rear surface closely attached to the cabinet, a front surface parallel to the rear surface, a vertical one side surface configured to connect the front surface to the rear surface, and the other side surface disposed obliquely to be parallel to the longitudinal direction of the rack, the other side surface being adjacent to a rotation center of the door.

13. The refrigerator of claim 12, wherein the rack cover is provided as a block having a trapezoidal horizontal cross-section.

14. The refrigerator of claim 13, wherein the rear surface of the rack cover has an area greater than that of the front surface.

15. The refrigerator of claim 10, wherein the rack cover is rotatably connected to the rack body by a rotational shaft.

16. A refrigerator comprising:

a cabinet including a storage chamber;

a door configured to open and close the storage chamber; and a door opening device disposed in the door and configured to open the door, wherein the door opening device comprises:

a motor configured to generate driving force, a rack that extends along a longitudinal direction and that is configured to move along the longitudinal direction based on driving of the motor to open the door, the longitudinal direction of the rack being inclined with respect to a front surface of the cabinet in the longitudinal direction, and a rack cover that is disposed at the door or the cabinet and that is rotatably connected to a distal end of the rack by a rotational shaft, the rack cover being configured to, based on movement of the rack, move together with the rack and contact the cabinet to transmit force to the cabinet.

17. The refrigerator of claim 1, wherein the rack defines an acute angle with respect to the front surface of the cabinet in the state in which the door is closed.

18. The refrigerator of claim 16, wherein the rack comprises a first end portion disposed adjacent to the front surface of the cabinet, and a second end portion disposed at an opposite side of the first end portion, wherein the door is rotatably connected to the cabinet by a hinge and comprises a door sidewall disposed adjacent to the hinge, and wherein, in a state in which the door is closed, a horizontal distance between the door sidewall and the first end portion is less than a horizontal distance between the door sidewall and the second end portion.

19. The refrigerator of claim 18, wherein the rack defines an acute angle with respect to the front surface of the cabinet in the state in which the door is closed.

20. The refrigerator of claim 16, wherein the rotational shaft extends perpendicular to the longitudinal direction, and the rack cover is configured to rotate about the rotational shaft based on the rack contacting the cabinet or the door.

* * * * *